US006006814A

United States Patent [19]

Dalpe

[11] Patent Number: 6,006,814

[45] Date of Patent: Dec. 28, 1999

[54] METHOD AND STRUCTURE FOR INSTALLING AN OVERHEAD AND HINGE DOOR COMBINATION

[76] Inventor: Guy Dalpe, 12265 26th Avenue, Riviere-des-Prairies, Quebec, Canada, H1E 1Y6

[21] Appl. No.: 09/166,894

[22] Filed: Oct. 6, 1998

[51] Int. Cl.[6] ..... E06B 3/48

[52] U.S. Cl. ..... 160/116; 160/201

[58] Field of Search ..... 160/116, 119, 160/117, 118, 201, 180, 181, 182, 186, 405

[56] References Cited

U.S. PATENT DOCUMENTS

| | | | |
|---|---|---|---|
| 1,989,657 | 1/1935 | McCloud | 160/116 |
| 1,989,658 | 1/1935 | McCloud | 160/116 |
| 2,017,012 | 10/1935 | Morgan | 160/116 |
| 2,275,730 | 3/1942 | Casse | 160/119 X |
| 2,309,436 | 1/1943 | Blodgett | 160/119 X |
| 2,540,810 | 2/1951 | Clark | 160/116 |

*Primary Examiner*—David M. Purol

[57] ABSTRACT

A method and a structure for dividing a door opening such as a conventional garage door opening and allowing for easy installation of both a side mounted swinging door and an overhead type door. A main post is used for both supporting one of the tracks of the overhead door and acting as part of the frame of the swinging door. The post as a specific cross-sectional configuration allowing it to serve its dual purpose. A threshold component is provided for acting both as a threshold for the swinging door and as an anchor for the lower end of the main post. Similarly, a header component is provided for acting both as a header for the swinging door and as an anchor for the upper end of the main post.

17 Claims, 4 Drawing Sheets

METHOD AND STRUCTURE FOR INSTALLING AN OVERHEAD AND HINGE DOOR COMBINATION

FIELD OF THE INVENTION

The present invention relates to the general field of doors and is particularly concerned with a method and structure for installing a hinged and overhead door combination.

BACKGROUND OF THE INVENTION

Overhead door assemblies have been in use for many years for closing the door openings of sheds, garages and the like. There exists at least two main types of overhead door assemblies. The first type often referred to by the term "up-and-over door" typically consists of a single stiff panel. The second type is also most popular and is often referred to as "sliding, articulated or panel door". This second type includes a plurality of hingedly interconnected panels.

This latter type of retractable overhead doors is conventionally constructed of a number of vertically arranged horizontal panels that can fold along the horizontal divisions between the panels, thereby enabling the door to assume a rolled or folded configuration as they pass along a curved path before being retracted into or adjacent the ceiling of the building in which they are installed. The panels assume a vertically juxtaposed planar configuration when lowered into a bottom position to thereby present a solid face and closed door opening.

The stacked panels are typically provided with two or more hinge assemblies between each other. The hinge assemblies at each side of the door run in parallel tracks that are installed vertically on each side of the door and curved at the top before becoming horizontal parallel tracks, suspended from the ceiling of the building. Such doors are typically manually operated or can be automatically operated by using infrared or radio operated motors which pull the panels of the door upwardly along the tracks when the door is being opened and push the door downwardly to a closed position, when reversed.

Overhead type doors are generally preferred for closing relatively large door openings such as garage or warehouse door openings since they require lesser space for installation and operation thereof than conventional side mounted swinging doors that require sidewise clearance for opening and closing thus using up useful space. However, overhead type doors suffer from drawbacks associated with their inherent structures. Indeed, overhead type doors are relatively heavy and difficult to manipulate from the opened to the closed position and vise versa.

When operated through motors, they require a relatively considerable amount of energy. Also, the hinged nature of most conventional overhead doors inherently causes the latter to rattle or shake during opening and closing thus creating sometimes obnoxious noises. Furthermore, opening of overhead door inherently leads to a momentarily relatively large leak in the thermal insulation barrier of the associated building structure and, hence, leads to a potentially relatively large waste of both energy and money.

Accordingly, it would thus be highly desirable in certain situations to combine the specific advantages associated with both side mounted swinging and overhead doors while allowing an intended user to circumvent the disadvantages associated with both types of door assemblies. In order to combine the advantages of both types of doors and circumvent their inherent disadvantages, both types of doors would ideally be offered to a potential user. The intended user could then selectively choose either the side mounted swinging door or the overhead door depending on the situation.

For example, whenever an intended user merely needs to walk into the garage he or she would merely use the side mounted swinging door thus circumventing the hereinabove disadvantages associated with overhead door assemblies. However, whenever a relatively large access to the garage would be needed as for example when a car needs to be driven into or out of the garage, the overhead door assembly could still be used.

It is therefore an object of the present invention to provide a method and structure for reversibly operationally dividing a door opening so as to allow for the installation of both an overhead and a side mounted swinging door and allow selective opening and closing of both types of door.

Conventional overhead doors are mounted to an overhead door frame which is incorporated into a wall of the building or garage. The door frame which is adapted to position and hang the overhead garage door includes a pair of vertical frame members connected to a horizontal frame member. The door frame elements are commonly welded together by the manufacturer and then transported to the construction or building site for incorporation into the building or garage. The garage door itself is hung from the door frame in association with a track or other mechanism for slidably opening and closing the door.

The door frames of this type are often fabricated from steel welded together that is manufactured and then shipped to the construction or job site. Consequently, the manufacturer must perform expensive and laboring intensive steps of welding and securing the frame elements to one another. Once constructed, the door frame requires substantial space for transportation to the job site being heavy and difficult to handle because of its steel construction. Furthermore, in that each door frame is assembled by the manufacturer, frequently when it arrives at the construction site modifications to either the door frame or the building into which it is to be incorporated are required due to damages during shipment or building design changes.

In that each door frame is assembled by the manufacturer, it is often intended for a specific type of door or application and later changes in building requirements or specifications result in the door frame being returned to the manufacturer while a different door frame is ordered and delivered to the job site resulting in construction downtime and costly delays. These type of problems associated with conventional and thus relatively simple overhead door frames would be compounded in the context of providing a dual purpose door frame that could be used both for a side mounted swinging door and an overhead door. It would thus be desirable to provide a structure that could easily be assembled at the job site Advantages of the present invention include the fact that the proposed method and structure allows for the installation of both a side mounted swinging door and overhead type door in a common door opening. The proposed method not only allows for the installation of such a door combination in a new door opening but also allows for the conversion of door opening already provided with a single relatively large overhead door assembly.

The proposed structure is specifically designed so as to be readily mounted in a conventional door opening through a set of simple and ergonomic steps without the need for special tooling or manual dexterity. The proposed structure allows the door opening to be partitioned or sectioned while retaining an esthetical pleasing visual aspect. Furthermore, the proposed assembly provides a structurally sturdy and reliable guiding and supporting frame for both the side mounted swingable door and the overhead door.

Still further, the proposed structure optionally has built-in means for increasing the thermal insulating characteristics of the assembly. Also, the proposed structure is specifically designed so as to be manufacturable with conventional components using conventional forms of manufacturing so as to provide a structure that is economically feasible, long lasting and relatively trouble free in operation.

A still further advantage of the present invention resides in that the proposed structure can be readily unassembled when not required so as to allow an intended user to readily remove the side mounted swinging door components thus readily increasing the overall width of the door opening in situations when for example a larger vehicle needs to be driven in or out of the garage.

A still further advantage of the present invention thus resides in the fact that the proposed structure can be easily assembled by the installer at the construction site with a minimum amount of handling and without the use of complicated fastener mechanisms to maintain the frame elements in an assembled configuration.

The structure can be transported to the job site with a minimum amount of ease and easily assembled on the job site with a minimal amount of labor, materials and time. The door frame is adapted for use both in extension spring and torsion spring garage door applications.

In accordance with one version of the invention there is provided a method for installing both an overhead door and a side mounted swing door across a door opening for allowing selective closing thereof; the door aperture defining first and second door aperture side peripheral edges, upper and lower door aperture peripheral edges; the swinging door being provided with swing door hinges; the overhead door including a plurality of door panels hinged together along adjacent longitudinal edges thereof by panel hinge assemblies, the hinge assemblies having rollers rotatably mounted thereto and extending laterally therefrom, the rollers being configured and sized for running in corresponding guiding tracks, each of the guiding tracks including a track first segment and a track second segment; each of the track first segments having a first segment rectilinear lower portion and a curved upper portion, each of the track first segment being adapted to extend substantially vertically in a generally parallel relationship with the first and second door aperture side peripheral edges; each of the track second segments being adapted to extend from a corresponding curved portion in a generally horizontal orientation; the method comprising the steps of:

defining an overhead door section and an adjacent swing door section in the door opening, the overhead door section being sized for operationally receiving the overhead door and the swing door section being sized for operationally receiving the swing door;

positioning a main post between the overhead door section and the adjacent swing door section with the main post extending between the upper and lower door aperture peripheral edges in a generally parallel relationship with the first and second door aperture peripheral edges, the main post defining a main post first longitudinal end and a longitudinally opposed main post second longitudinal end;

firmly stabilizing the main post with a post stabilizing means;

using the first door aperture peripheral edge and the main post as operational lateral edges for the overhead door;

using the second door aperture peripheral edge and the main post as operational lateral edges for the swing door.

According to one embodiment (not shown) the main post is used for mounting the swing door edges. According to another embodiment the second door aperture peripheral edge is used for mounting the swing door edges.

Preferably the method also includes the step of securing one of the tracks to the main post and the other one of the tracks to the first door aperture peripheral edge.

Conveniently it also comprises the steps of anchoring a threshold component to an adjacent ground surface so that the threshold component extends across a swing lower edge segment of the door opening lower peripheral edge delimited by the swing door section and anchoring the main post first longitudinal end to the threshold component; whereby the threshold component is adapted to act both as a threshold-post anchoring means for anchoring the main post first longitudinal end and as a threshold for the swing door.

Preferably it also includes the steps of anchoring a header component to the second door aperture peripheral edge so that the header component extends across a swing upper edge segment of the door opening upper peripheral edge delimited by the swing door section; anchoring the main post second longitudinal end to the header component; whereby the header component is adapted to act both as a header-post anchoring means for anchoring the main post second longitudinal end and as a header for the swing door.

In accordance with the present invention there is also provided a structure for installing both an overhead door and a side mounted swing door across a door opening for allowing selective closing thereof; the door aperture defining first and second door aperture side peripheral edges, upper and lower door aperture peripheral edges; the door opening also defining an overhead door section and an adjacent swing door section in the door opening, the overhead door section being sized for operationally receiving the overhead door and the swing door section being sized for operationally receiving the swing door; the swinging door being provided with swing door hinges; the overhead door including a plurality of door panels hinged together along adjacent longitudinal edges thereof by panel hinge assemblies, the hinge assemblies having rollers rotatably mounted thereto and extending laterally therefrom, the rollers being configured and sized for running in corresponding guiding tracks, each of the guiding tracks including a track first segment and a track second segment; each of the track first segments having a first segment rectilinear lower portion and a curved upper portion, each of the track first segment being adapted to extend substantially vertically in a generally parallel relationship with the first and second door aperture side peripheral edges; each of the track second segments being adapted to extend from a corresponding curved portion in a generally horizontal orientation; the structure comprising: a main post having a generally elongated configuration; the main post defining a main post first longitudinal end and a longitudinally opposed main post second longitudinal end; the main post being provided with track attachment means for attaching one of the tracks thereto, the main post being also configured for acting as an operational edge for the swing door.

Preferably, the main post has a generally constant cross sectional configuration along its length defining a main post supporting section extending into a main post track connecting section.

Conveniently, the cross sectional configuration of the supporting section is given a generally hollow L shaped configuration defining a first supporting segment bending integrally and substantially perpendicularly into a second supporting segment; the second supporting segment, in turn, bending integrally and substantially perpendicularly into a third supporting segment extending away from the second supporting segment and bending integrally and substantially perpendicularly into a fourth supporting segment; a fifth supporting segment extending substantially perpendicularly from the fourth supporting segment in a direction leading towards the second supporting segment; the fifth supporting segment bending integrally and substantially perpendicularly into a sixth supporting segment that merges with the first supporting segment.

Preferably, the track mounting segment takes the form of a substantially rectilinear segment extending substantially perpendicularly away from the fourth supporting segment.

Conveniently, the first, second, third and fourth supporting segments are formed integrally of a unitary channel while the fifth and sixth supporting segments along with the track mounting segment are formed integrally of a generally L shaped channel.

Preferably the structure further includes a framed header extending horizontally between the door opening second peripheral edge and the main post for stabilizing the main post second longitudinal end, the frame header being fixed at a first longitudinal end thereof to the door opening second peripheral edge and at a second longitudinal edge thereof to the main post.

Preferably the structure further includes a threshold for both securing the main post first longitudinal end and acting as a threshold for the side mounted swinging door; the threshold component including a first threshold plate adapted to extend underneath the swinging door in register with the supporting section of the main post, the first threshold plate having a threshold-post anchoring means attached thereto for allowing releasable anchorage of the post first longitudinal end to the first threshold plate.

Conveniently, the threshold-post anchoring means takes the form of a generally L shaped first anchoring clip having an anchoring clip first segment mounted to the undersurface of the threshold first and a generally perpendicularly oriented anchoring clip second segment extending substantially parallel to a lateral edge of the threshold first plate for creating a first anchoring spacing therebetween; the first anchoring spacing being configured and sized for fittingly and slidably receiving a longitudinal end of the third supporting segment.

Conveniently, the threshold component is further provided with a second threshold component extending in a generally parallel relationship with the first threshold component; the length of the threshold second component exceeding that of the threshold first component so that the threshold second component protrudes and abuttingly contacts the outer surface of the track mounting segment; the threshold second segment having a track anchoring means attached thereto for releasably anchoring the lower longitudinal end of the track longitudinal segment to the threshold second segment.

Preferably, the releasable track anchorage means takes form of a track anchoring clip having a track anchoring clip third segment attached to an undersurface of the second threshold; the track anchoring clip also having a substantially perpendicular oriented track anchoring clip second segment that extends in a generally parallel relationship with the lateral edge of the threshold second segment, defining a track spacing therebetween for fittingly and slidably receiving the combination of the track rectilinear segment and the track mounting segment.

Preferably the structure further includes a third threshold plate adapted to extend parallel to the first threshold plate opposite the second threshold plate, the length of the third threshold plate exceeding that of the second threshold plate and thus to protruding laterally from the latter; the third threshold plate being adapted to be positioned outwardly relative to the swinging door when the latter is its closed configuration.

BRIEF DESCRIPTION OF THE DRAWINGS

An embodiment of the present invention will now be described, by way of example, in reference to the following drawings in which.

DETAILED DESCRIPTION OF THE DRAWINGS

Figure 1:
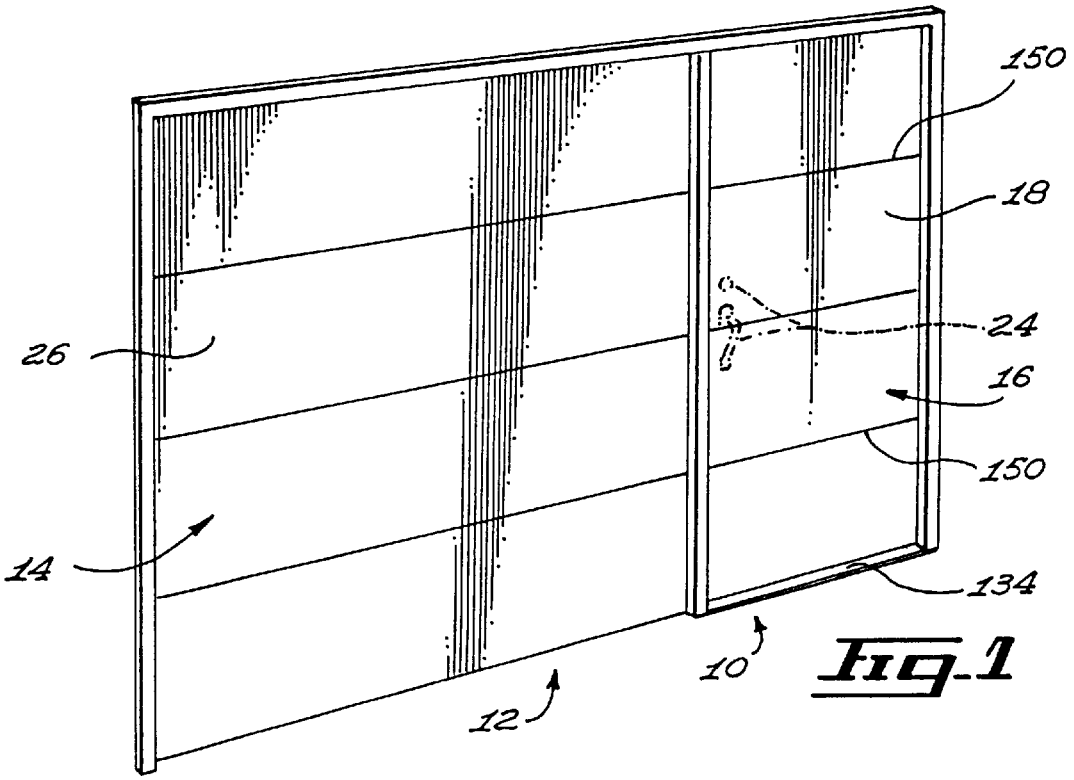
FIG. 1, in a front perspective view, illustrates a partitioning structure in accordance with an embodiment of the present invention being used to partition a door opening into a side mounted swinging door section and an overhead door section.
Figure 2:
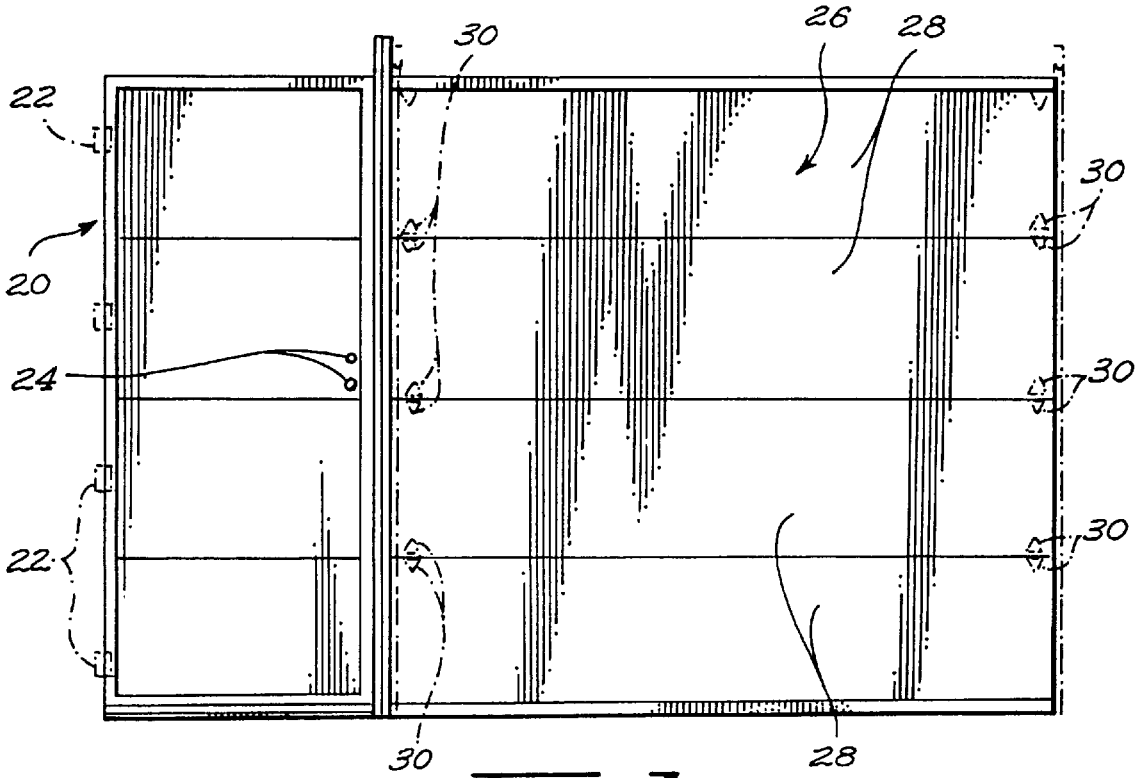
FIG. 2, in a rear elevational view, illustrates the structure shown in FIG. 1 as seen from the interior of the door opening.

Referring to FIG. 1, there is shown a partitioning structure 10 part of a closure assembly frame in accordance with an embodiment of the present invention. The partitioning structure 10 is shown partitioning a door opening 12 into an overhead door section 14 and a swinging door section 16.

The swinging door section 16 is adapted to be selectively closed by a conventional side mounted swinging door 18 hingedly mounted to a side peripheral edge 20 of the door opening 12 by conventional door hinges 22. The swinging door 18 is adapted to be optionally provided with conventional lock and handle assembly 24 preferably positioned adjacent an opposed longitudinal edge of the door 18 as is well known in the art.

The opening in the overhead door section 14 is adapted to be selectively closed by a conventional overhead door 26. The conventional overhead door 26 typically includes a plurality of door panels 28 hinged together along adjacent longitudinal edges thereof by conventional panel hinges 30.

The hinge assemblies 30 are typically located adjacent the side peripheral edges of the overhead door 26 and are provided with rollers (not shown) rotatably mounted thereto and extending laterally therefrom. The rollers are adapted to run in parallel guiding tracks mounted on each side of the overhead door 26 as is well known in the art.

Each guiding track typically include a first track segment 32 adapted to extend vertically in a lateral relationship with the peripheral edge of the overhead door 26 and defining an upper curved end segment 34. The track then typically extends into a track second segment 36 adapted to extend substantially horizontally in a suspended relationship relative to the ceiling of the building. A lower panel 28 of the overhead door 26 is typically mechanically coupled to a biasing means for biasing the door towards its opened or closed configuration.

Figure 3:
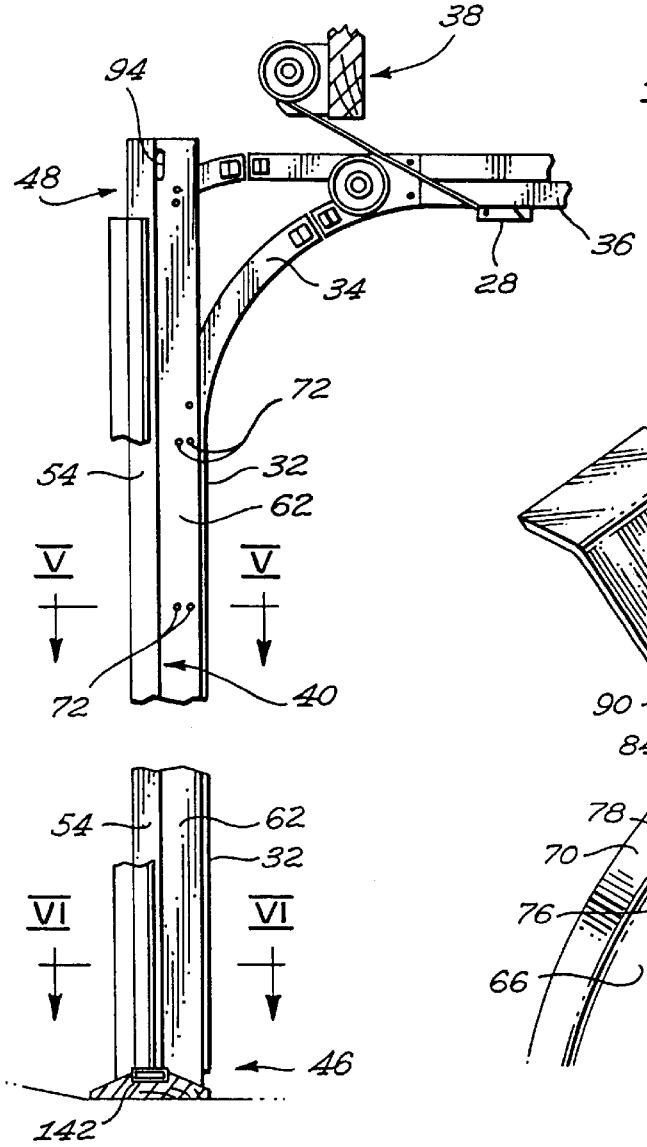
FIG. 3, in a partial side view with sections taken out, illustrates part of the partitioning structure with the overhead door being partly shown in an opened configuration.
Figure 4:
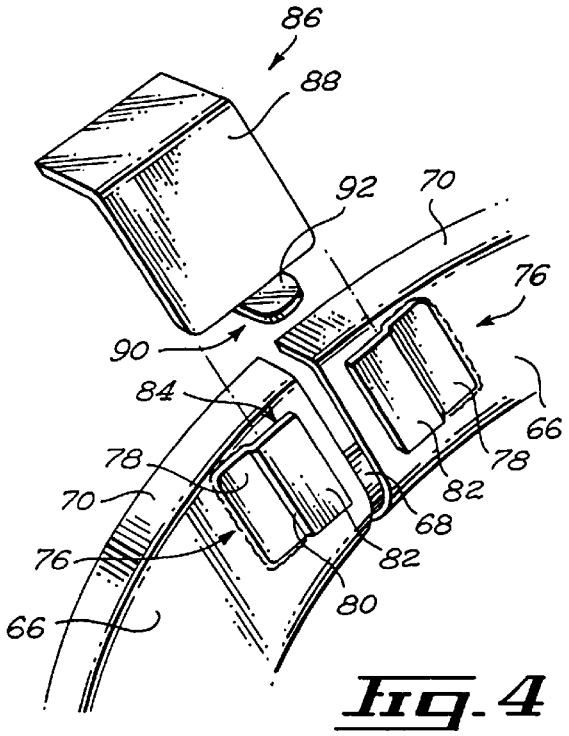
FIG. 4, in a partial perspective view with sections taken out, illustrates a clipping component part of the partitioning structure, the clipping component being used for connecting track sections used for guiding the overhead door.
Figure 5:
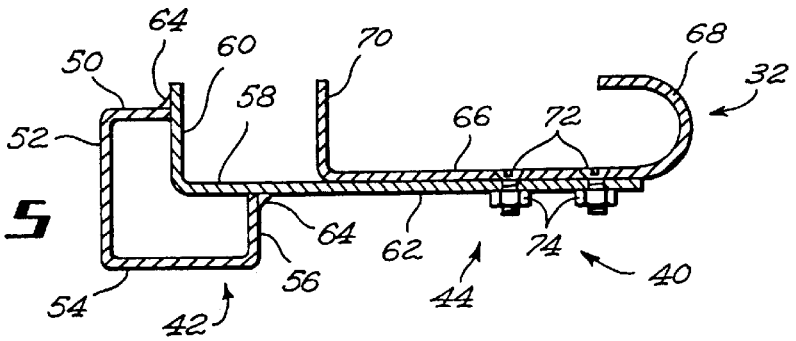
FIG. 5, in a transversal cross sectional view taken along arrows 55 of FIG. 3, illustrates the cross sectional configuration of a main post part of the partitioning structure in accordance with an embodiment of the present invention.

When the overhead door 26 is adapted to be manually operated the biasing means typically takes the form of an extension spring or a torsion spring while infrared or radio operated motors can be used for automatically operating the overhead door 26 as is well known in the art. In FIG. 3, the door biasing means is schematically illustrated and is designated by the reference #38.

The partitioning structure 10 includes a main post 40 adapted to be positioned between the sliding door section 16 and the overhead door section 14. The main post 40 has a generally elongated configuration defining a main post first end section 46 and a longitudinally opposed main post second end section 48.

The main post 40 has a generally constant cross sectional configuration along its length defining a main post supporting section 42 extending into a main post track connecting section 44. The cross sectional configuration of the supporting section 42 is preferably given a generally hollow L shaped configuration defining a first supporting segment 50 bending integrally and substantially perpendicularly into a second supporting segment 52.

The second supporting segment 52, in turn, bends integrally and substantially perpendicularly into a third supporting segment 54 extending away from the second supporting segment 52 and bending integrally and substantially perpendicularly into a fourth supporting segment 56. A fifth supporting segment 58 extends substantially perpendicularly from the fourth supporting segment 56 in the direction leading towards a second supporting segment 52. The fifth supporting segment 58 bends integrally and substantially perpendicularly into a sixth supporting segment 60 merging with the first supporting segment 50.

It should be understood that the supporting section 42 could have other cross sectional configurations without departing from the scope of the present invention as long as it provides for a cross sectional configuration having an adequate bending inertia for allowing proper support to the overhead door 26 and associated structures. The track mounting segment 44 preferably takes the form of a substantially rectilinear segment 62 extending substantially perpendicularly away from the fourth supporting segment 56.

In a preferred embodiment of the invention, the first, second, third and fourth supporting segments 56 are formed integrally of a unitary channel while the fifth and sixth supporting segments 58, 60 along with the track mounting segment 62 are formed integrally of a generally L shaped channel. Both channels are preferably made out of a suitable metallic alloy and assembled together using weld lines 64 or any other suitable means.

The guiding track 32 preferably takes the form of a conventional guiding track including a guiding track rectilinear segment 66 bending integrally adjacent a longitudinal edge thereof into a guiding track curved segment 68 and at an opposed longitudinal edge thereof into a guiding track perpendicular segment 70. A guiding track curved segment 68 is typically adapted to contact the rollers extending from the lateral edges of the panels 28.

The guiding track 32 is adapted to be attached to the track mounting segment 44 of the main post 40 using conventional fastening means such as bolt 72 and nut 74 assemblies extending through both the rectilinear track segment 66 and the segment 62. The bolt 72 and nut assemblies 74 are preferably grouped in pairs spaced along the length of the vertical track 32 and the main post 40 as shown in FIG. 3.

It should be understood that other means for mounting the guiding track 32 to the track mounting segment 44 part of the main post 40 such as rivets, weld lines or the like could be used without departing from the scope of the present invention as long as the connecting means provide for a suitable connection preventing movement therebetween. Also, it should be noted that the relatively elongated configuration of the segment 62 allows for customization of the spacing between the track curved segment 68 and the supporting segment 42 of the main post 40 and thus for adjustment of the door 26 relative to the door aperture.

In order to facilitate installation of the dividing structure 10, the conventional guiding track for guiding the overhead door 26 attached to the main post 40, is preferably modified so as to form two separate track components adapted to be assembled on the site. Preferably, the first track component includes the first track section 32 and its associated curved section 34 while the second track component includes the second track section 36.

The end sections of both the curved section 34 and the second track section 36 are thus provided with a releasable track assembly means for assembling the curved section 34 to the second track section 36. The releasable track assembly means preferably includes a track bracket attached respectively to the proximal end of the track second segment 36 and the distal end of the curved segment 34. Each track bracket 76 preferably defines a first track bracket mounting segment 78 having a generally flat configuration and adapted to be mounted to the outer surface of the track rectilinear segment 66.

A bracket spacing segment 80 extends substantially perpendicularly from the bracket mounting segment 78. A bracket clipping segment 82 extends substantially perpendicularly from the bracket spacing segment 80 in a spaced relationship with the track rectilinear segment 66 defining a clipping spacing 84 therebetween. A retaining clip 86 having a generally L shaped clip flame 88 and a clipping tongue 90 extending therefrom is adapted to be used for resiliently clipping the brackets 76 together.

The tongue 90 has a first segment thereof (not shown) adapted to be positioned within the spacing 84 while the clip frame 88 abuttingly contacts the outer surface of the segments 82 and the tongue abutment segment 92 abuttingly contacts a peripheral edge of the segments 82. The resilient nature of the tongue 90 allows the latter to be removed when required. In order to further facilitate installation of the main post 40 the latter is provided with an assembly aperture 94 adjacent its second longitudinal end 48.

A framed header 96 is adapted to extend horizontally between the peripheral edge of the door opening and the main post 40 for stabilizing the upper section of the latter. The frame header 96 preferably takes the form of a beam fixed at a first longitudinal end thereof to a peripheral edge of the door aperture and at a second longitudinal edge thereof to the main post 40.

Figure 12:
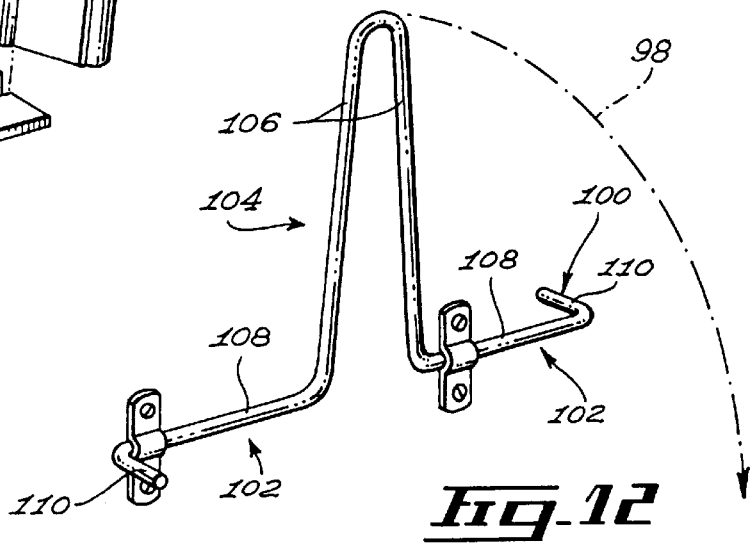
FIG. 12, in a perspective view, illustrates a clipped component used for locking the main post component to the header component both shown in FIGS. 9 and 10.

A releasable header fastening means is preferably provided for releasably mounting the second end section 48 of the post 40 to the header 96. The releasable header mounting means preferably takes the form of a header mounting clip 98 shown in greater details in FIGS. 9, 10 and 12.

The header mounting clip 98 includes a generally L shaped clip hook section 100 adapted to be releasably inserted through the preferably elongated aperture 94. The hook section 100 extends integrally into a hinge section 102 allowing the hook section 100 to be pivotally attached to the header 96.

Figure 9:
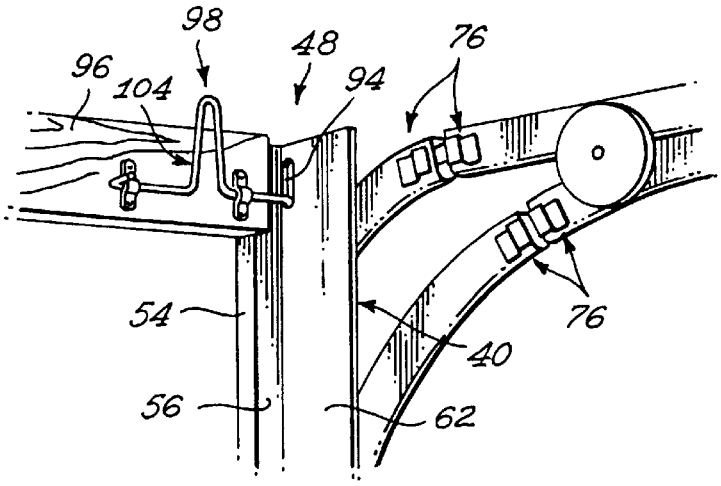
FIG. 9, in a partial rear perspective view with sections taken out, illustrates part of the header frame component assembled to the main post components and sections of the guiding tracks about to be assembled together.
Figure 10:
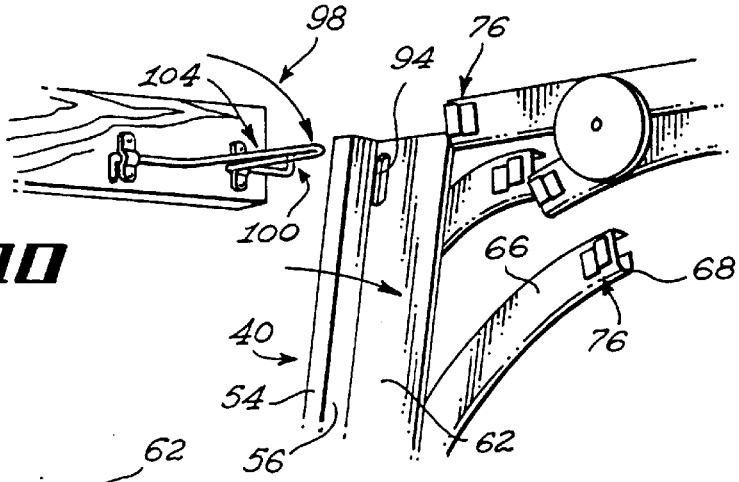
FIG. 10, in a partial rear perspective view with sections taken out, illustrates the header, main post and track components being disassembled from each other.

The hinge section 102, in turn, extends integrally into a handle section 104 adapted to be used for pivoting the hinge section 102 and thus the hook section 100 between a locking configuration shown in FIG. 9 wherein the hook section 100 abuttingly contacts a segment 62 and an unlocked configuration shown in FIG. 10 wherein the hook section 100 is positioned so as to allow its slidable removal through its sliding passage through the aperture 94.

In a preferred embodiment of the invention, the header clip 98 takes the form of an integral wire bent so as to define a generally V shaped handle 106 bending integrally into a pair of parallel wire hinge segments 108. The wire hinge segments 108, in turn, bend substantially perpendicularly at a distal end thereof into wire locking segments 110 extending in a diametrical plane perpendicular to both the handle segments 106 and the hinge segments 108.

A threshold component 112 is adapted to be used for both securing the main post first longitudinal end 46 and acting as a threshold for the side mounted swinging door 18. The threshold component 112 is shown in greater details in FIGS. 6, 7, 8 and 11.

The threshold 112 includes a first threshold plate 114 adapted to extend underneath the swinging door 18 in register with the supporting section 42 of the main post 40. The first threshold plate 114 has a releasable threshold-post anchoring means attached thereto for allowing releasable anchorage of the post first longitudinal end 46 to the first threshold plate 114.

Figure 6:
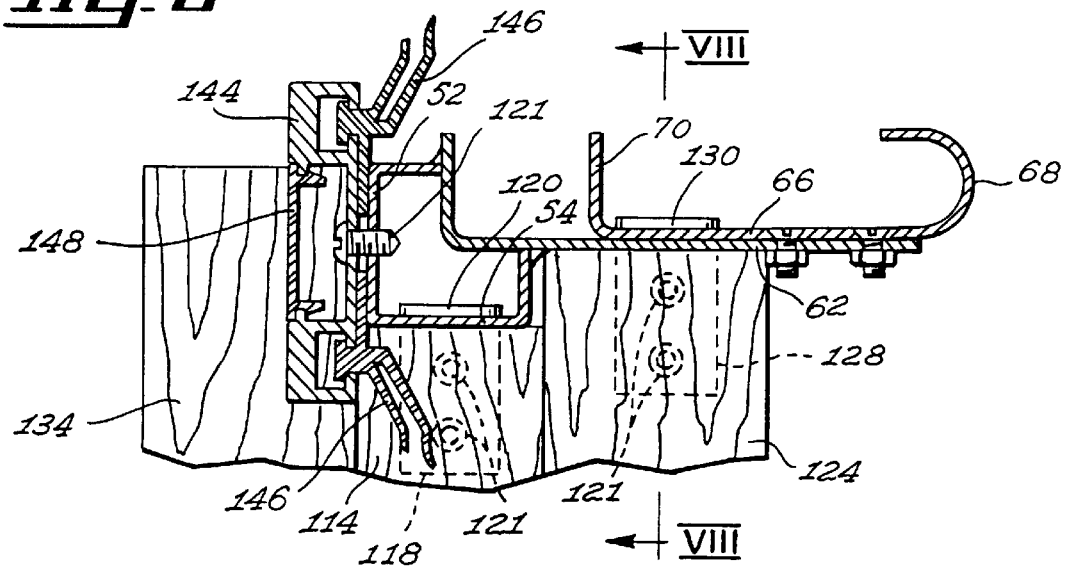
FIG. 6, in a transversal cross sectional view taken along arrows 6—6 of FIG. 3, illustrates the cross sectional configuration of the main post shown in FIG. 5 with a decorative and weather shield structure mounted thereon, the main post being shown assembled to a threshold component.
Figure 7:
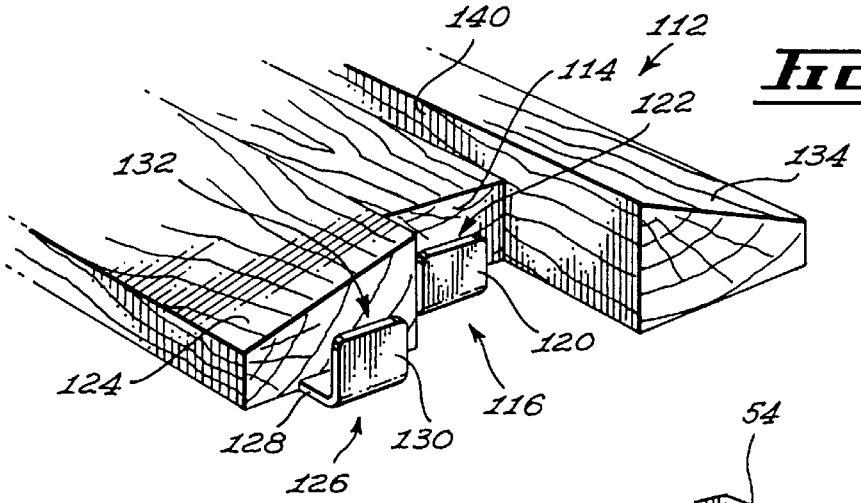
FIG. 7, in a partial perspective view with sections taken out, illustrates part of the threshold component shown in FIG. 6 with its anchoring clips extending therefrom.

The releasable threshold-post anchoring means preferably takes the form of a generally L shaped first anchoring clip 116 having an anchoring clip first segment 118 mounted to the undersurface of the threshold first plate 114 by conventional fixing means such as bolts 121. The L shaped first anchoring clip 116 also includes a generally perpendicularly oriented anchoring clip second segment 120 extending substantially parallel to a lateral edge of the threshold first plate 114 and creating a first anchoring spacing 122 therebetween. As shown in FIG. 6, the first anchoring spacing 122 is preferably configured and sized for fittingly and slidably receiving a longitudinal end of the third supporting segment 54.

The threshold component 112 is preferably further provided with a second threshold component 124 extending in a generally parallel relationship with the first threshold component 114. The length of the threshold second component 124 exceeds that of the threshold first component 114 so that the threshold second component 124 protrudes and abuttingly contacts the outer surface of the track mounting segment 62 as shown in FIG. 6.

The threshold second segment 124 preferably has a releasable threshold-track anchoring means attached thereto for releasably anchoring a lower segment of the track rectilinear segment 32 to the second threshold plate 124. The releasable threshold-track anchorage means preferably takes form of a track anchoring clip 126 having a track anchoring clip first segment 128 attached to an undersurface of the second threshold component 124 by suitable fastening means such as screws or bolt 120.

Figure 8:
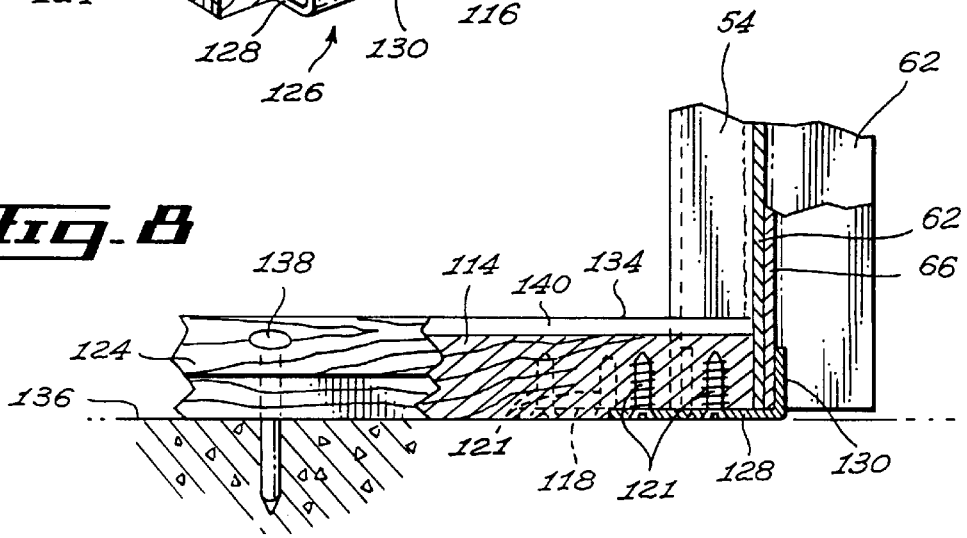
FIG. 8, in a partial longitudinal cross sectional view taken along arrows 88 of FIG. 6, illustrates the connection between the main post and the threshold component.
Figure 11:
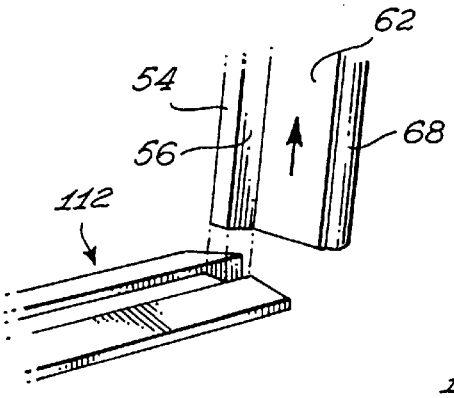
FIG. 11, in a rear perspective view with sections taken out, illustrates the main post component being retracted from the threshold component.

The track anchoring clip 126 also has a substantially perpendicular oriented track anchoring clip second segment 130 extending in a generally parallel relationship with the lateral edge of the second threshold plate 124 and defining a track spacing 132 therebetween for fittingly and slidably receiving both a lower end of the track rectilinear segment 66 and the track mounting segment 62 as shown in FIGS. 6 and 8. Both the post and track anchoring clips 116 and 126 allow for quick and easy assembly as well as disassembly of the track 32 and main post 40 combination to the threshold component 112 as shown in FIG. 11 by a mere sliding action.

A third threshold plate 134 is adapted to extend in a generally parallel relationship with the first threshold plate 114 opposite the second threshold plate 124. The length of the third threshold plate 134 is adapted to exceed that of the second threshold plate 124 and thus to protrude laterally from the latter. The third threshold plate 134 is adapted to be positioned outwardly, as shown in FIG. 1 relative to the swinging door 18 when the latter is its closed configuration.

Both the second and third threshold plates 124, 134 preferably have a generally beveled cross sectional configuration for esthetical and functional purposes as is well known in the art. The first threshold component 114 is adapted to be respectively attached to the second and third threshold components 124, 134 along its longitudinal lateral edges by conventional fastening means such as glues, screws or the like. Alternatively, the first, second and third threshold component 114, 124 and 134 could be made out of an integrally extruded piece of material.

As shown in FIG. 8, the threshold component 112 is adapted to be anchored to a ground surface 136 using conventional fastening means such as nails 138. The first threshold component 114 is preferably vertically recessed relative to the adjacent second and third threshold component 124, 134 so as to define a vertical threshold recess 140 therebetween adapted to fittingly receive a corresponding threshold stepping plate 142 shown in FIG. 3 as is well known in the art.

As shown in FIG. 6, the dividing structure 10 is preferably optionally provided with both an esthetic plate 144 and weather strips 146 for both the overhead door 26 and the swinging door 18. The esthetic strip 144 preferably takes the form of an elongated and generally flat channel adapted to be mounted to the second supporting segment 52 part of the main post 40 through the use of conventional fastening components such as screws 146.

The screws 146 are adapted to be hidden by a hiding plate 148 as is well known in the art. Weather proofing strips 146 are slidably attached to the component 144 as is well known in the art. The weather proofing strips 146 are preferably made out of an elastomeric material.

In order to further improve the overall esthetical appearance of the combination swinging door 18 and overhead door 26, the swinging door 18 may be provided with indicia 150 marked thereon so as to assimilate the appearance of the peripheral edges of the panels 28 forming the overhead door 26.

The embodiments of the invention in which an exclusive privilege or property is claimed are defined as follows:

1. A method for installing both an overhead door and a side mounted swing door across a door opening for allowing selective closing thereof; said door opening defining first and second door aperture side peripheral edges, upper and lower door aperture peripheral edges; said swinging door being provided with swing door hinges; said overhead door including a plurality of door panels hinged together along adjacent longitudinal edges thereof by panel hinge assemblies, said hinge assemblies having rollers rotatably mounted thereto and extending laterally therefrom, said rollers being configured and sized for running in corresponding guiding tracks, each of said guiding tracks including a track first segment and a track second segment; each of said track first segments having a first segment rectilinear lower portion and a curved upper portion, each of said track first segment being adapted to extend substantially vertically in a generally parallel relationship with said first and second door aperture side peripheral edges; each of said track second segments being adapted to extend from a corresponding curved portion in a generally horizontal orientation; said method comprising the steps of:

defining an overhead door section and an adjacent swing door section in said door opening, said overhead door section being sized for operationally receiving said overhead door and said swing door section being sized for operationally receiving said swing door;

positioning a main post between said overhead door section and said adjacent swing door section with said main post extending between said upper and lower door aperture peripheral edges in a generally parallel relationship with said first and second door aperture peripheral edges, said main post defining a main post first longitudinal end and a longitudinally opposed main post second longitudinal end;

firmly stabilizing said main post with a post stabilizing means;

using said first door aperture peripheral edge and said main post as operational lateral edges for said overhead door;

using said second door aperture peripheral edge and said main post as operational lateral edges for said swing door.

2. A method as recited in claim 1 wherein said main post is used for mounting said swing door edges.

3. A method as recited in claim 1 wherein second door aperture peripheral edge is used for mounting said swing door edges.

4. A method as recited in claim 1 further comprising the step of securing one of said tracks to said main post and the other one of said tracks to said first door aperture peripheral edge.

5. A method as recited in claim 1 further comprising the steps of anchoring a threshold component to an adjacent ground surface so that said threshold component extends across a swing lower edge segment of said door opening lower peripheral edge delimited by said swing door section:

anchoring said main post first longitudinal end to said threshold component; whereby said threshold component is adapted to act both as a threshold-post anchoring means for anchoring said main post first longitudinal end and as a threshold for said swing door.

6. A method as recited in claim 1 further comprising the steps of anchoring a header component to said second door aperture peripheral edge so that said header component extends across a swing upper edge segment of said door opening upper peripheral edge delimited by said swing door section:

anchoring said main post second longitudinal end to said header component; whereby said header component is adapted to act both as a header-post anchoring means for anchoring said main post second longitudinal end and as a header for said swing door.

7. An overhead door and a side mounted swing door structure installed across a door opening for allowing selective closing thereof; said door opening defining first and second door aperture side peripheral edges, upper and lower door aperture peripheral edges; said door opening also defining an overhead door section and an adjacent swing door section in said door opening, said overhead door section being sized for operationally receiving said overhead door and said swing door section being sized for operationally receiving said swing door; said swinging door being provided with swing door hinges; said overhead door including a plurality of door panels hinged together along adjacent longitudinal edges thereof by panel hinge assemblies, said hinge assemblies having rollers rotatably mounted thereto and extending laterally therefrom, said rollers being configured and sized for running in corresponding guiding tracks, each of said guiding tracks including a track first segment and a track second segment; each of said track first segments having a first segment rectilinear lower portion and a curved upper portion, each of said track first segment being adapted to extend substantially vertically in a generally parallel relationship with said first and second door aperture side peripheral edges; each of said track second segments being adapted to extend from a corresponding curved portion in a generally horizontal orientation; said structure comprising:

a main post having a generally elongated configuration; said main post defining a main post first longitudinal end and a longitudinally opposed main post second longitudinal end; said main post being provided with track attachment means for attaching one of said tracks thereto, said main post being also configured for acting as an operational edge for said swing door.

8. A structure as recited in claim 7 wherein said main post has a generally constant cross sectional configuration along its length defining a main post supporting section extending into a main post track connecting section.

9. A structure as recited in claim 8 wherein the cross sectional configuration of said supporting section comprises a generally hollow Lshaped configuration defining a first supporting segment bending integrally and substantially perpendicularly into a second supporting segment; said second supporting segment, in turn, bending integrally and substantially perpendicularly into a third supporting segment extending away from said second supporting segment and bending integrally and substantially perpendicularly into a fourth supporting segment; a fifth supporting segment extending substantially perpendicularly from said fourth supporting segment in a direction leading towards said second supporting segment; said fifth supporting segment bending integrally and substantially perpendicularly into a sixth supporting segment that merges with said first supporting segment.

10. A structure as recited in claim 8 wherein said track mounting segment takes the form of a substantially rectilinear segment extending substantially perpendicularly away from said fourth supporting segment.

11. A structure as recited in claim 9 wherein said first, second, third and fourth supporting segments are formed integrally of a unitary channel while said fifth and sixth supporting segments along with said track mounting segment are formed integrally of a generally L shaped channel.

12. A structure as recited in claim 7 further comprising: a framed header extending horizontally between said door opening second peripheral edge and said main post for stabilizing said main post second longitudinal end, said frame header being fixed at a first longitudinal end thereof to said door opening second peripheral edge and at a second longitudinal edge thereof to said main post.

13. A structure as recited in claim 7 further comprising a threshold for both securing said main post first longitudinal end and acting as a threshold for said side mounted swinging door; said threshold component including a first threshold plate adapted to extend underneath said swinging door in register with said supporting section of said main post, said first threshold plate having a threshold-post anchoring means attached thereto for allowing releasable anchorage of said post first longitudinal end to said first threshold plate.

14. A structure as recited in claim 13 wherein said threshold-post anchoring means takes said form of a generally L shaped first anchoring clip having an anchoring clip first segment mounted to the undersurface of said threshold first and a generally perpendicularly oriented anchoring clip second segment extending substantially parallel to a lateral edge of said threshold first plate for creating a first anchoring spacing therebetween; said first anchoring spacing being configured and sized for fittingly and slidably receiving a longitudinal end of said third supporting segment.

15. A structure as recited in claim 14 wherein said threshold component is further provided with a second threshold component extending in a generally parallel relationship with said first threshold component; the length of said threshold second component exceeding that of said threshold first component so that said threshold second component protrudes and abuttingly contacts the outer surface of said track mounting segment; said threshold second segment having a track anchoring means attached thereto for releasably anchoring the lower longitudinal end of said track longitudinal segment to said threshold second segment.

16. A structure as recited in claim 15 wherein said releasable track anchorage means takes form of a track anchoring clip having a track anchoring clip third segment attached to an undersurface of said second threshold; said track anchoring clip also having a substantially perpendicular oriented track anchoring clip second segment that extends in a generally parallel relationship with the lateral edge of said threshold second segment, defining a track spacing therebetween for fittingly and slidably receiving said combination of said track rectilinear segment and said track mounting segment.

17. A structure as recited in claim 16 further comprising a third threshold plate adapted to extend parallel to said first threshold plate opposite said second threshold plate, the length of said third threshold plate exceeding that of said second threshold plate and thus to protruding laterally from the latter; said third threshold plate being adapted to be positioned outwardly relative to said swinging door when the latter is its closed configuration.

* * * * *